United States Patent [19]

Peiser et al.

[11] 4,239,618

[45] Dec. 16, 1980

[54] TWIN TOWER DISTILLATION OF CRUDE OIL

[75] Inventors: Alfred M. Peiser, Rocky Hill, N.J.; Ronald I. Graham, Yardley; Joseph R. McClernon, Morrisville, both of Pa.

[73] Assignee: Mobil Oil Corporation, New York, N.Y.

[21] Appl. No.: 37,794

[22] Filed: May 10, 1979

[51] Int. Cl.[3] ..... C10G 7/00

[52] U.S. Cl. ..... 208/355; 208/356

[58] Field of Search ..... 208/350, 355, 356

[56] References Cited

U.S. PATENT DOCUMENTS

| | | | |
|---|---|---|---|
| 2,736,688 | 2/1956 | Kraft | 208/355 |
| 3,301,778 | 1/1967 | Cabbage | 208/356 |
| 3,320,158 | 5/1967 | Potts | 208/355 |
| 3,338,825 | 8/1967 | Taggart | 208/350 |

*Primary Examiner*—Herbert Levine

*Attorney, Agent, or Firm*—C. A. Huggett; R. J. Cier

[57] ABSTRACT

A sequential twin tower fractionation arrangement for separating crude oil is described which is particularly concerned with lowering fractionation heat requirements in conjunction with reducing steam utilization in the combination operation.

5 Claims, 1 Drawing Figure

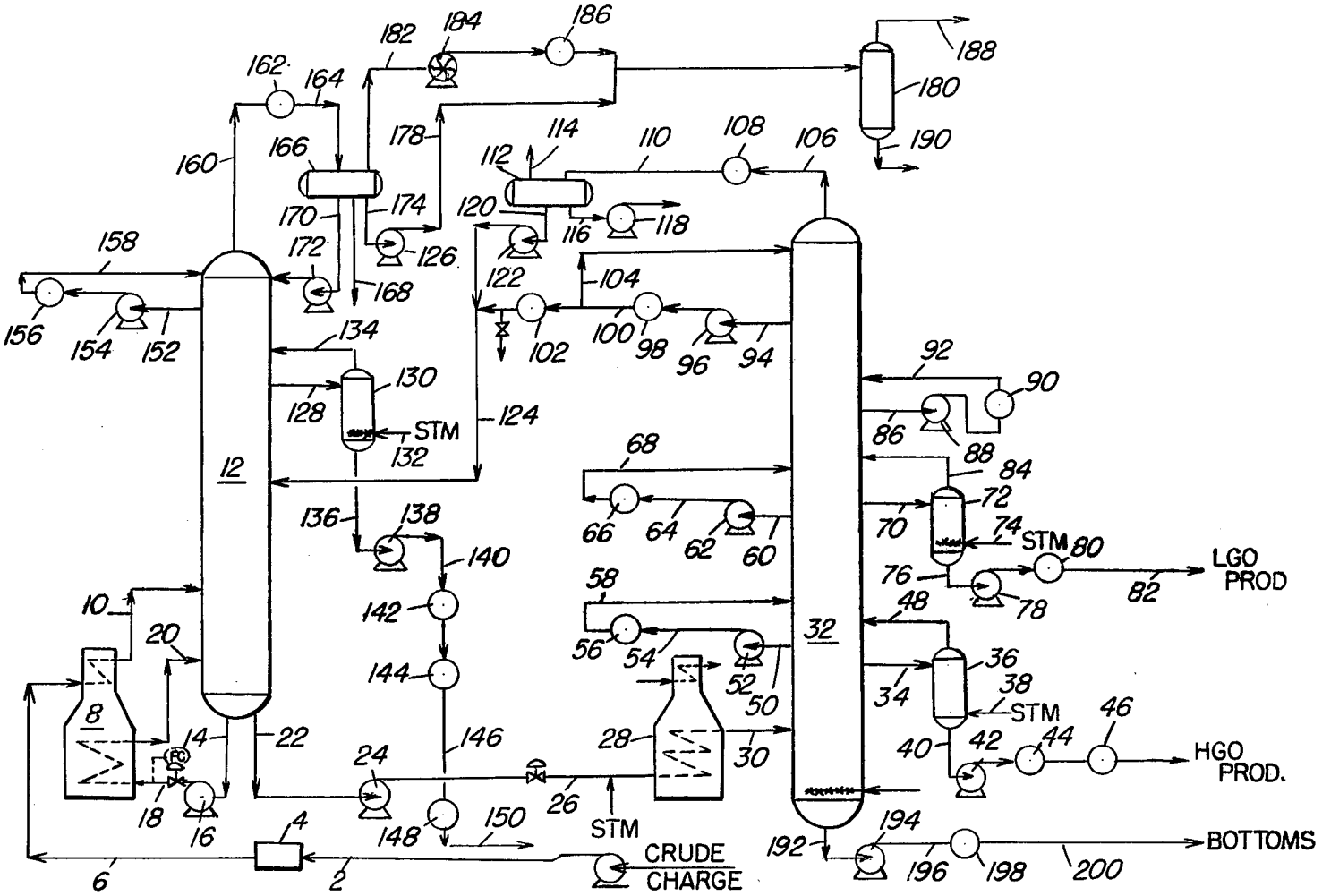
LGO PROD
HGO PROD.
BOTTOMS
STM
CRUDE CHARGE

TWIN TOWER DISTILLATION OF CRUDE OIL

BACKGROUND OF THE INVENTION

Countercurrent liquid-vapor fractionation such as used in distillation and adsorption columns is a separational procedure used most frequently in the petroleum and chemical industry. The investment in fractionating equipment, auxiliary operating equipment, piping and operating costs represents a large item in plant costs which it is most desirable to reduce.

In the conventional prior art processing of crude petroleum oil to recover fractions thereof suitable for upgrading in various refinery processing operations, the crude is first distilled or fractionated in an atmospheric distillation tower with residual material separated from the bottom of the atmospheric distillation tower being further separated in a vacuum distillation tower. In this combination operation, gas and gasoline are recovered as overhead products of the atmospheric distillation tower, heavy naphtha, kerosene and light gas oils are taken off as side streams and the residual material is recovered from the bottom of the tower as reduced crude. This residual fraction from the atmospheric distillation tower is then passed to a vacuum distillation tower. The products of vacuum distillation include vacuum gas oil and heavy residual material known as vacuum reduced crude.

In the conventional prior art operation, the crude oil is heated by heat exchange means and furnace means in order to vaporize a portion of the crude to produce the products recovered from the atmospheric distillation tower. The preheated crude normally enters the lower portion of the tower and the vapors therefrom rise through the tower wherein they are cooled in selected stages producing successively lighter liquids which are separately withdrawn as sidestream products. Excess liquid runback known as overflash material joins the liquid portion of the entering crude to form the crude tower bottoms. Steam may be introduced to the bottom of the tower and various side strippers used to remove light material from withdrawn heavier liquid products.

In a large fractionating column where there are multiple withdrawals of the products comprising gas oils and lower boiling materials, the heat supplied must be sufficiently high to cause a more complete vaporization of the crude oil charge for flow upwardly through the tower. The vaporized material is condensed, collected and separated from different levels in the tower. In general therefore, a great amount or more usually an excessive amount of heat is required and provided to vaporize large portions of the crude along with some heavy bottom or residual material in order to provide the necessary amount of reflux material required in the tower above the feed inlet. Without this excess vaporization there is little or no reflux on the tower plates as required for efficient operation.

The present invention is concerned with improving upon an atmospheric-vacuum tower combination operation for separating crude oil which will improve upon the overall economies of the operation and reduce particularly the heat utility requirements of the operation.

SUMMARY OF THE INVENTION

The present invention relates to an improved method and sequence of processing steps for separating petroleum crude oil into its low and higher boiling hydrocarbon fractions. The process combination of the invention generally comprises two separate stages of distillation of reduced pressure in the direction of flow of higher boiling hydrocarbons therethrough wherein at least the first step of distillation is equal to or above atmospheric pressure. In this two stage distillation combination, the operating parameters of heating and cooling are restricted, selected and interrelated in a manner to more efficiently transport available heat and restrict the fuel requirements of the operation for obtaining the desired fractionation of the crude oil charge. More particularly in this combination, the crude oil is initially heated sufficiently in a first tower distillation stage to particularly vaporize a relatively light kerosene fraction or a low boiling fraction of kerosene as well as lower boiling components of the crude oil charge without causing overheating and undesired overflash or cracking of the charged crude oil. The portion of the crude oil charge boiling above a light kerosene fraction is withdrawn from a bottom portion of the first distillation tower and further heated in a furnace zone to a temperature of about 711° F., and then the further heated oil is passed into a bottom portion of a second distillation tower of the sequence of distillation towers. The second tower may be equal to, above or below atmospheric pressure. In the second distillation tower, pump-arounds, product withdrawals and satellite stripping of separately withdrawn product streams of light gas oil and heavy gas oil are obtained in a manner generally known in the art. The bottom resid fraction, higher boiling than a separated heavy gas oil fraction, is recovered from the bottom of the second tower for further processing as desired.

A particularly important aspect of the two tower distillation operation of the invention is the recovery of a selected kerosene boiling range fraction significantly comprising higher boiling components thereof which are cooled, condensed and recycled as reflux material to each of the first and second distillation towers. The recycle of the heavy kerosene boiling range material at an elevated temperature within the range of about 150° to 200° F. from the second tower to an intermediate portion of the first tower and beneath the kerosene withdrawal tray of the first tower operates to restrict, depending on temperature, the end boiling point of the kerosene fraction recovered from the first tower and the boiling range of the naphtha fraction recovered from the first tower. This operation reduces the heat duty requirements of the first distillation tower. Thus, recycling the separated kerosene at a high temperature to the first tower will operate to extend the boiling range of the naphtha recovered from the first tower as well as change the boiling range of the kerosene fraction recovered from the first tower. Thus the process sequence and selective distillation temperature conditions permitted in the combination reduce thermodegradation of the charged oil to each distillation zone. The high pressure distillation operation effected in the first of the sequence of distillation towers requires only a relatively low temperature in the bottom portion of the tower which is sufficient to distill overhead with the aid of heat from charged crude oil and recycled heavy kerosene, a lighter kerosene and lower boiling components of the crude oil charged. This lower temperature reboiler operation is instrumental in circumventing the normal requirement of charging stripping steam to a bottom portion of a relatively high pressure distillation tower to reduce coking of recycled oil in the furnace tubes of the reboiler system. Thus the twin tower distillation operation above briefly identified distributes the heat requirements of the separating operation in a most advantageous manner, significantly increasing the overall efficiency of the operation and reducing fuel requirements.

BRIEF DESCRIPTION OF THE DRAWING

The drawing is a diagrammatic sketch in elevation of two distillation towers in pressure decreasing sequence arranged with respect to one another to separate crude oil into desired light and heavier oil fractions under more efficient distillation conditions.

DISCUSSION OF A SPECIFIC EMBODIMENT

Referring now to the drawing by way of example, a crude oil charge in conduit 2 is passed through heat exchange and a desalter system 4 and thence by conduit 6 through heat exchange means not shown and furnace 8 wherein the charged crude oil is raised to a temperature of about 480° F. The heated crude oil is then passed by conduit 10 to an intermediate tray of distillation tower 12. A portion of the crude oil comprising higher boiling components is withdrawn from the bottom of tower 12 at an elevated temperature by conduit 14 connected to pump 16 and thereafter passed by conduit 18 to furnace 8. In furnace 8, the withdrawn bottom fraction in conduit 14 is heated to a temperature of about 638° F. and then returned to a low portion of tower 12 by conduit 20. By maintaining a low temperature profile in a bottom portion of tower 12 and a wide boiling range portion of the charged crude oil including heavy kerosene with the higher boiling components thereof in the reboiler fraction, the need for adding steam to prevent coking in the furnace tubes is substantially reduced, if no eliminated.

A portion of the charged crude oil comprising a relatively heavy boiling range portion of the kerosene components and higher boiling material collected in a relatively low portion of tower 12 is withdrawn by conduit 22 at a temperature of about 638° F. and passed to pump 24 and then by conduit 26 to furnace 28. In furnace 28, the oil in conduit 26 is heated to a temperature of about 711° F. before passing by conduit 30 to a bottom portion of the second fractionating tower 32 and between about tray 7 and 8 thereof. The two tower fractionation arrangement herein discussed is pdressure balanced to maintain tower 32 equal to or at a lower pressure than tower 12 and tower 32 may be equal to, above or below atmospheric pressure. In a preferred arrangement, tower 12 is maintained with a top pressure of about 29 psia and a temperature of about 271° F. Tower 32 is maintained with a top pressure of about 20 psia and a temperature of about 263° F. Some steam is added to the bottoms fraction in conduit 26 if required before heating of this kerosene containing heavy oil stream in furnace 28 to a higher temperature. Steam is also added to a bottom portion of tower 32 to aid stripping of low boiling components from higher boiling components. The amount added will depend upon the end boiling point of the heavy portion of the crude oil passed to tower 32. Tower 32 is generally operated under conditions to maintain a bottom temperature of about 707° F. and a top temperature of about 263° F.; however, this can be varied to some considerable degree without departing from the scope and essence of the invention. In a very specific arrangement, tower 32 is operated under conditions to permit the withdrawal of a heavy gas oil (HGO) comprising fraction from about tray 13 or 14 by conduit 34 for passage to a satellite stripping zone 36 to which stripping steam is introduced by conduit 38. A stripped heavy gas oil is withdrawn from stripper 36 at a temperature of about 614° F. by conduit 40 for passage through pump 42 and then to heat exchangers or coolers 44 and 46. Crude oil components lower boiling than the heavy gas oil above recovered and stripping steam are passed by conduit 48 to tower 32 for separation and recovery as hereinafter discussed.

A pump-around oil stream withdrawn at a temperature of about 637° F. from about tray 13 by conduit 50 and connected to pump 52 is then passed by conduit 54 to heat exchanger 56 wherein the withdrawn oil temperature is lowered to about 537° F. from 637° F. before return to a higher level in the tower by conduit 58. A second pump-around stream withdrawn by conduit 60 about tray 21 is passed to pump 62 and by conduit 64 to heat exchanger 66 wherein the temperature of this pump-around stream is reduced from 576° F. to about 479° F. before return to a higher level of the tower by conduit 68.

A light gas oil (LGO) comprising fraction is withdrawn from tower 32 about tray level 22 by conduit 70 for passage to a satelltie stripping zone 72 to which stripping steam is introduced by conduit 74. A light gas oil stripped of lower boiling components is withdrawn from zone 72 by conduit 76 communicating with pump 78 and heat exchaner 80. The light gas is withdrawn from heat exchanger 80 by conduit 82. Heat exchange means 80 comprises a plurality of heat exchange means. Low boiling components stripped from the light gas oil fraction in zone 72 and stripping steam are returned to tower 32 by conduit 84 above about tray level 22. A third pump-around stream is withdrawn from an upper portion of tower 32 by conduit 86 above about tray level 26. This withdrawn pump-around oil stream at a withdrawn temperature of about 420° F. in conduit 86 is passed to pump 88 and thence to heat exchanger means 90 such as two parallel heat exchange means wherein the temperature of the oil is reduced from 420° F. to a lower temperature and down to about 320° F. before return to a higher portion of the tower above withdrawal conduit 86 by conduit 92.

A hydrocarbon fraction referred to herein as a kerosene fraction and more usually the higher boiling portion of kerosene boiling range material is withdrawn from an upper portion of tower 32 at a temperature of about 335° F. by conduit 94 communicating with pump 96 and heat exchange means 98. In heat exchange means 98, the temperature of the higher boiling kerosene fraction in conduit 94 is reduced from about 335° F. to about 224° F. and recovered therefrom by conduit 100 communicating with heat exchanger 102. In heat exchanger 102, the temperature of the higher boiling or relatively keavy kerosene fraction is further reduced to about 185° F. A portion of the heavy kerosene in conduit 100 is passed by conduit 104 as reflux to an upper portion of tower 32. Uncondensed materials, vaporous hydrocarbons and stripping steam are withdrawn from the top of tower 32 by conduit 106 communicating with heat exchanger 108 wherein the temperature of the withdrawn stream is reduced to about 150° F. The thus cooled material is passed by conduit 110 to knockout drum or overheat accumulator 112 wherein a separation is made to recover gaseous material by conduit 114, a condensed sour water stream withdrawn by conduit 116 communicating with pump 118 and a condensed light oil fraction at a temperature of about 150° F. recovered by conduit 120 and communicating with pump 122. The condensed light oil fraction thus recovered is combined with recovered heavy kerosene cooled on heat exchanger 102 and the mixture thus formed is passed by conduit 124 at a mix temperature of about 180° F. to an intermediate portion of tower 12 but above the crude charge inlet by conduit 10.

In an upper portion of tower 12 and above the inlet of material recycled by conduit 124, a separation is made to recover a desired kerosene boiling range fraction separated from lower boiling components in the crude oil charge comprising naphtha boiling hydrocarbons and formed gaseous components. Thus, as mentioned above, the composition of the withdrawn kerosene fraction and the separately recovered naphtha may be varied to some extent by the temperature conditions maintained in the upper portion of tower 12 and above the inlet of the recycled material in conduit 124 obtained as herein specifically defined.

A desired boiling range kerosene fraction is withdrawn from tower 12 by conduit 128 for passage to a satellite stripping zone 130 to which stripping steam is introduced by conduit 132 for stripping components boiling below the desired kerosene fraction thereafter withdrawn by conduit 136. Stripped hydrocarbons and stripping steam are returned to tower 12 by conduit 134. A kerosene fraction of desired ASTM boiling range is recovered from stripping zone or vessel 130 by conduit 136 at a temperature of 332° F. communicating with pump 138. The kerosene is then passed by conduit 140 through heat exchangers 142 and 144 and by conduit 146 to heat exchanger 148 for recovery therefrom by conduit 150. In this sequence of steps, the kerosene fraction recovered at a temperature of about 332° F. from vessel 130 is cooled to about 184° F. in exchanger 142 and further cooled to about 150° F. in exchanger 144. A final cooling to about 100° F. is accomplished by exchanger 148.

In an upper portion of tower 12, a pump-around stream lower boiling than the recovered kerosene fraction and comprising naphtha boiling material is withdrawn by conduit 152 at a temperature of 271° F. communicating with pump 154 and heat exchanger 156. In exchanger 156, the withdrawn fraction is cooled from about 271° F. to about 222° F. before return by conduit 158 to an upper or top portion of tower 12. Uncondensed gaseous or vaporous material is withdrawn from the top of tower 12 by conduit 160, cooled in heat exchanger 162 to a temperature of about 150° F. and passed by conduit 164 to overhead accumulator drum or knockout drum 166. In drum 166, a separation is made to recover condensed sour water removed by conduit 168, a naphtha fraction withdrawn by conduit 170 for recycle as reflux to the top of tower 12 with the aid of pump 172. A portion of the naphtha stream recovered by conduit 170 or a separate portion withdrawn by conduit 174 from drum 166 is passed by pump 126 and conduit 178 to a low temperature separator drum 180. Uncondensed gaseous material withdrawn from drum 166 by conduit 182 communicating with pump 184 is further cooled in heat exchanger 186 before being passed to separator drum 180. A separation is made in drum 180 to remove a noncondensed gaseous fraction by conduit 188 from a naphtha fraction boiling above about 100° F. recovered by conduit 190.

Referring again to tower 32, a heavy bottoms fraction higher boiling than the recovered heavy gas oil is removed from the bottom of tower 32 by conduit 192, pump 194, conduit 196 and a series of heat exchange zones represented by heat exchanger 198, thereby reducing the temperature of the bottoms fraction to an acceptable level for recovery by conduit 200. The heavy bottoms fraction or resid withdrawn from the bottom of tower 32 may be passed through a combination of parallel heat exchange zones (not shown) to accomplish cooling of the resid.

In a specific embodiment, it is contemplated recovering from the combination of towers product fractions particularly identified by Table 1 below.

TABLE 1

| ASTM DISTILLATIONS | Kerosene | Recycle Kerosene | LGO |
|---|---|---|---|
| IBP °F. | 281 | 347 | 459 |
| 5% | 322 | 377 | 488 |
| 10% | 343 | 393 | 503 |
| 50% | 385 | 442 | 557 |
| 90% | 440 | 487 | 635 |
| 95% | 452 | 504 | 653 |
| EBP | 476 | 537 | 688 |

Having thus generally described the method and process of the invention and discussed specific embodiments in support thereof, it is to be understood that no undue restriction are to be imposed by reason thereof except as defined by the following claims.

We claim:

1. A method for fractionating crude oil into component streams suitable for further processing which comprises, partially heating a crude oil stream to a temperature sufficient to separate a kerosene boiling range material into a low boiling fraction and a higher boiling range kerosene fraction in a first separation zone, withdrawing the higher boiling range kerosene fraction along with higher boiling material of the crude oil charge from said first separation zone, heating the withdrawn material in the presence of steam to a higher temperature than initially heated and passing the heated higher boiling material to a second separation zone, separating the material charged to the second separation zone into a heavy gas oil fraction, a light gas oil fraction, a kerosene and lighter fraction and a bottoms fraction higher boiling than the separated heavy gas oil fraction, cooling and condensing the kerosene and lighter fraction of said second separation operation to form a low temperature condensate fraction comprising kerosene, passing the low temperature condensate fraction comprising kerosene to said first separation zone above the charge point of said partially heated crude oil, and separating the condensate fraction comprising kerosene in an upper portion of said first separation at lower temperatures permitting the recovery of kerosene boiling range material, naphtha boiling range material and materials lower boiling than naphtha.

2. The method of claim 1 wherein the operating temperatures employed in said first and second separation zones are adjusted to modify the end boiling point of the kerosene boiling fraction recovered from an upper portion of the first separation zone.

3. The method of claim 1 wherein heating of the crude oil charge is accomplished in the absence of steam and heating of the higher boiling portion of the crude charged to the second separation zone is accomplished in the presence of steam.

4. The method of claim 1 wherein separation of the crude oil charged to the first separation zone is accomplished in the absence of stripping steam and the temperature in the bottom portion of the separation zone is maintained by reboiling a portion of the high boiling material therein.

5. The method of claim 1 wherein condensate material lower boiling than light gas oil recovered from the upper portion of the second separation zone is cooled to a level promoting the separation and recovery of kerosene boiling range material from an upper portion of said first separation zone.

* * * * *

UNITED STATES PATENT AND TRADEMARK OFFICE

CERTIFICATE OF CORRECTION

PATENT NO. : 4,239,618

DATED : December 16, 1980

INVENTOR(S) : A.M. Peiser, R.I. Graham and J. R. McClernon

It is certified that error appears in the above-identified patent and that said Letters Patent are hereby corrected as shown below:

Col. 3, Line 47: "pdressure" should read -- pressure --

Col. 5, Line 16: insert --fraction-- after "naphtha"

Signed and Sealed this

Seventh Day of April 1981

[SEAL]

*Attest:*

RENE D. TEGTMEYER

*Attesting Officer*

*Acting Commissioner of Patents and Trademarks*